US011713629B2

(12) United States Patent
Primevert

(10) Patent No.: US 11,713,629 B2
(45) Date of Patent: Aug. 1, 2023

(54) DRILL ROD WITH INTERNAL FLUID BYPASS PORTING

(71) Applicant: BLY IP INC., Salt Lake City, UT (US)

(72) Inventor: Vincent Primevert, Toronto (CA)

(73) Assignee: LONGYEAR TM, INC., Salt Lake City, UT (US)

( * ) Notice: Subject to any disclaimer, the term of this patent is extended or adjusted under 35 U.S.C. 154(b) by 60 days.

(21) Appl. No.: 16/968,634

(22) PCT Filed: Jan. 9, 2020

(86) PCT No.: PCT/US2020/012828
§ 371 (c)(1),
(2) Date: Aug. 10, 2020

(87) PCT Pub. No.: WO2020/146564
PCT Pub. Date: Jul. 16, 2020

(65) Prior Publication Data

US 2021/0047891 A1 Feb. 18, 2021

Related U.S. Application Data

(60) Provisional application No. 62/790,308, filed on Jan. 9, 2019.

(51) Int. Cl.
*E21B 17/18* (2006.01)
*E21B 17/22* (2006.01)

(52) U.S. Cl.
CPC ..... *E21B 17/18* (2013.01); *E21B 17/22* (2013.01)

(58) Field of Classification Search
CPC ..... E21B 17/00; E21B 17/18; E21B 17/22; E21B 21/12
See application file for complete search history.

(56) References Cited

U.S. PATENT DOCUMENTS

| | | | | |
|---|---|---|---|---|
| 5,425,428 | A * | 6/1995 | Chatagnier, Jr. | E21B 17/04 175/215 |
| 2011/0079433 | A1* | 4/2011 | Drenth | E21B 25/02 175/57 |
| 2013/0220700 | A1 | 8/2013 | Bauer et al. | |
| 2017/0051571 | A1* | 2/2017 | Drenth | E21B 25/00 |
| 2017/0191320 | A1* | 7/2017 | Drenth | E21B 17/20 |
| 2018/0187496 | A1* | 7/2018 | Kinsella | E21B 17/042 |

FOREIGN PATENT DOCUMENTS

| | | |
|---|---|---|
| WO | WO 2015/071381 A2 | 6/2015 |
| WO | WO 2015/179906 A1 | 12/2015 |

* cited by examiner

*Primary Examiner* — David Carroll
(74) *Attorney, Agent, or Firm* — Ballard Spahr LLP

(57) ABSTRACT

A drill rod can include a body having an outer surface, an inner surface, a longitudinal axis aligned with a drilling axis, and at least one longitudinally extending groove extending radially outwardly from the longitudinal axis relative to the inner surface. The inner surface and the at least one longitudinally extending groove can cooperate to define an interior space through which an inner assembly can be received as the inner assembly is advanced and retracted relative to the drilling axis. The at least one longitudinally extending groove of the body of the drill rod can be configured to permit axial flow of fluid through the drill rod as portions of the inner assembly engage the inner surface of the body of the drill rod.

20 Claims, 5 Drawing Sheets

DRILL ROD WITH INTERNAL FLUID BYPASS PORTING

CROSS-REFERENCE TO RELATED APPLICATION

This is a U.S. National Phase Application of International Application No. PCT/US2020/012828, filed Jan. 9, 2019, which claims priority to and the benefit of U.S. Provisional Patent Application No. 62/790,308, filed Jan. 9, 2019, the entirety of which are hereby incorporated by reference herein.

FIELD

This invention relates to drill rods and, more particularly, to drill rods with an internal fluid bypass.

BACKGROUND

Often, when drilling, undesirable fluid pressure can accumulate at the distal end of the drill string. This fluid can originate from drilling fluid (e.g., pumped-in fluid) or ground sources. The fluid backpressure can be particularly undesirable in up-hole drilling (i.e., drilling vertically upward), especially during tool retrieval. Accordingly, providing a flow path to relieve the fluid buildup can be desirable.

SUMMARY

Disclosed herein, in one aspect, is a drill rod having fluid bypass porting. A drill rod can be configured to form a portion of a drill string defining a drilling axis. The drill string can be configured to receive an inner assembly as the inner assembly is advanced and retracted relative to the drilling axis. The drill rod can comprise a body having an outer surface, an inner surface, a longitudinal axis aligned with the drilling axis, and at least one longitudinally extending groove extending radially outwardly from the longitudinal axis relative to the inner surface. The inner surface and the at least one longitudinally extending groove can cooperate to define an interior space through which the inner assembly is received as the inner assembly is advanced and retracted relative to the drilling axis. The at least one longitudinally extending groove of the body of the drill rod can be configured to permit axial flow of fluid through the drill rod as portions of the inner assembly engage the inner surface of the body of the drill rod.

The at least one longitudinally extending groove of the body of the drill rod can comprise a plurality of longitudinally extending grooves.

Each longitudinally extending groove can be oriented parallel or substantially parallel to the longitudinal axis of the body of the drill rod.

The plurality of longitudinally extending grooves can have respective helical profiles.

The body of the drill rod can comprise respective male and female end portions that define respective portions of the outer and inner surfaces of the body. The male end portion can define an outer thread extending radially outwardly from the outer surface of the body.

The female end portion of the body of the drill rod can define an inner thread on the inner surface of the body.

The at least one longitudinally extending groove can be longitudinally spaced from the male end portion of the body of the drill rod.

The plurality of longitudinally extending grooves can be equally or substantially equally circumferentially spaced about the inner surface of the body of the drill rod.

The plurality of longitudinally extending grooves can comprise from 6 to 14 grooves.

The plurality of longitudinally extending grooves can comprise 10 grooves.

The plurality of longitudinally extending grooves can comprise two grooves that are circumferentially spaced 180 degrees apart from one another.

The plurality of longitudinally extending grooves can comprise at least three grooves.

The longitudinally extending grooves can have variable depths.

A cross-sectional area defined by the at least one groove, defined by a plane that is perpendicular to the longitudinal axis, can be at least ten percent of a cross-sectional area defined by the inner surface of the body of the drill rod in the plane. The cross-sectional area defined by the at least one groove can be between ten percent and fifty percent of the cross-sectional area defined by the inner surface of the body of the drill rod.

The plurality of longitudinally extending grooves can be circumferentially spaced apart by unequal amounts about the inner surface of the body of the drill rod.

A drilling system can comprise a drill string including the drill rod as described above and an inner assembly including at least one sealing element that is configured to engage inner surfaces of the drill string. The at least one longitudinally extending groove of the body of the drill rod can be configured to permit axial flow of fluid through the drill rod as portions of the at least one sealing element of the inner assembly engage the inner surface of the body of the drill rod.

The at least one sealing element can be a pump-in seal.

The drill rod can be a first drill rod of a plurality of drill rods of the drill string, wherein the first drill rod is positioned at a proximal end of the drill string, wherein the drill string comprises a plurality of distally positioned drill rods having a cylindrical inner surface and positioned distal of the first drill rod, and wherein the at least one sealing element is configured to form a fluid seal with the inner surface of at least one of the distally positioned drill rods.

The inner assembly can comprise an overshot.

The overshot can be one of a wireline overshot and a strictly fluid-driven reversible overshot.

A method of using the drilling system can comprise positioning the at least one sealing element of the inner assembly within the interior space of the drill rod having the at least one longitudinally extending groove.

The method can further comprise, with the at least one sealing element within the interior space of the drill rod having the at least one longitudinally extending groove, allowing accumulated fluid to flow axially through the at least one longitudinally extending groove in a proximal direction.

The method can further comprise, with the at least one sealing element within the interior space of the drill rod having the at least one longitudinally extending groove, directing fluid axially through the at least one longitudinally extending groove in a distal direction.

Additional advantages of the disclosed system and method will be set forth in part in the description which follows, and in part will be understood from the description, or may be learned by practice of the disclosed system and method. The advantages of the disclosed system and method will be realized and attained by means of the elements and combinations particularly pointed out in the appended claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the disclosed apparatus, system, and method and together with the description, serve to explain the principles of the disclosed apparatus, system, and method.

DETAILED DESCRIPTION

Figure 1:
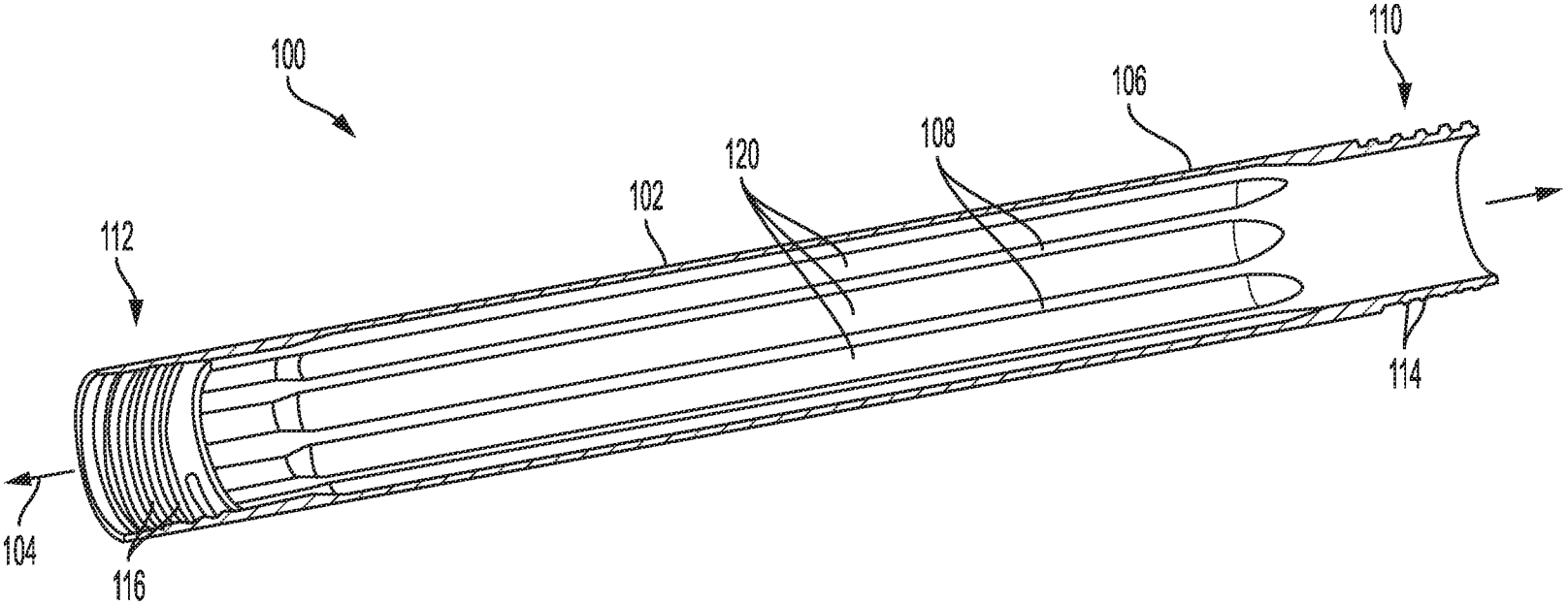
FIG. 1 is a cutaway perspective view of a drill rod as disclosed herein.

The disclosed system and method may be understood more readily by reference to the following detailed description of particular embodiments and the examples included therein and to the Figures and their previous and following description.

A. Definitions

It is to be understood that the terminology used herein is for the purpose of describing particular embodiments only and is not intended to limit the scope of the present invention which will be limited only by the appended claims.

It must be noted that as used herein and in the appended claims, the singular forms "a", "an", and "the" include plural references unless the context clearly dictates otherwise. Thus, for example, reference to "a drill rod" includes a plurality of such drill rods, and reference to "the drill rod" is a reference to one or more drill rods and equivalents thereof known to those skilled in the art, and so forth.

"Optional" or "optionally" means that the subsequently described event, circumstance, or material may or may not occur or be present, and that the description includes instances where the event, circumstance, or material occurs or is present and instances where it does not occur or is not present.

Ranges may be expressed herein as from "about" one particular value, and/or to "about" another particular value. When such a range is expressed, also specifically contemplated and considered disclosed is the range from the one particular value and/or to the other particular value unless the context specifically indicates otherwise. Similarly, when values are expressed as approximations, by use of the antecedent "about," it will be understood that the particular value forms another, specifically contemplated embodiment that should be considered disclosed unless the context specifically indicates otherwise. It will be further understood that the endpoints of each of the ranges are significant both in relation to the other endpoint, and independently of the other endpoint unless the context specifically indicates otherwise. Finally, it should be understood that all of the individual values and sub-ranges of values contained within an explicitly disclosed range are also specifically contemplated and should be considered disclosed unless the context specifically indicates otherwise. The foregoing applies regardless of whether in particular cases some or all of these embodiments are explicitly disclosed.

Optionally, in some aspects, when values are approximated by use of the antecedents "about," "substantially," or "generally," it is contemplated that values within up to 15%, up to 10%, up to 5%, or up to 1% (above or below) of the particularly stated value or characteristic can be included within the scope of those aspects.

Unless defined otherwise, all technical and scientific terms used herein have the same meanings as commonly understood by one of skill in the art to which the disclosed apparatus, system, and method belong. Although any apparatus, systems, and methods and materials similar or equivalent to those described herein can be used in the practice or testing of the present apparatus, system, and method, the particularly useful methods, devices, systems, and materials are as described.

Throughout the description and claims of this specification, the word "comprise" and variations of the word, such as "comprising" and "comprises," means "including but not limited to," and is not intended to exclude, for example, other additives, components, integers or steps. In particular, in methods stated as comprising one or more steps or operations it is specifically contemplated that each step comprises what is listed (unless that step includes a limiting term such as "consisting of"), meaning that each step is not intended to exclude, for example, other additives, components, integers or steps that are not listed in the step.

B. Drill Rod with Internal Fluid Bypass Porting

Figure 2B:
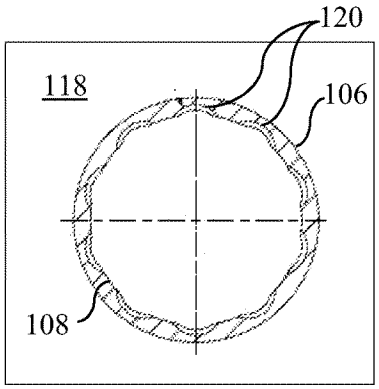
FIG. 2 is a cutaway side view of another drill rod as disclosed herein.
Figure 3B:
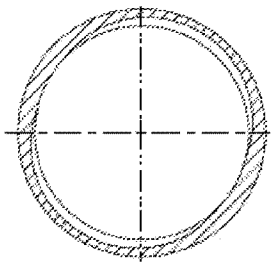
FIG. 3 is a cutaway side view of yet another drill rod as disclosed herein.

Disclosed herein is a drill rod with internal fluid bypass porting. Referring to FIGS. 1-3, a drill rod 100 can have a hollow, generally cylindrical body 102 that is elongated with respect to a longitudinal axis 104. The drill rod 100 can have an outer surface 106, an inner surface 108, a first end 110, and a second end 112. The first end 110 can define male threads 114 extending radially outwardly from the outer surface 106. The second end 112 can define female threads 116 on the inner surface 108. The male and female threads 114, 116 can be configured to engage other threaded drill string components.

The body 100 can further define one or more longitudinally extending grooves 120 that extend radially outward from the inner surface 108. In some embodiments, the one or more longitudinally extending grooves 120 can be oriented parallel or substantially parallel to the longitudinal axis of the body 102 of the drill rod 100. The grooves 120 can comprise one, two, three, four, five, six, seven, eight, nine, ten, eleven, twelve, thirteen, fourteen, or more grooves. The grooves 120 can be equally or unequally spaced from each other about the circumference of the body 100. In some embodiments, the body 102 can comprise two grooves 120 that are circumferentially spaced 180 degrees apart. In some embodiments, such as, for example, the drill rod as in FIG. 3, the longitudinally extending grooves 120 can comprise one or more helical grooves. Optionally, the grooves 120, as shown in FIG. 3, can comprise two helical grooves spaced 180 degrees apart. According to one aspect of the invention, the longitudinally extending grooves 120 can be axially spaced from the male end portion 112. That is, the grooves 120 do not extend to the male end portion (first end 110) of the body 100. In some embodiments, the longitudinally extending grooves 120 can, in cross-section in a plane 118 perpendicular to the longitudinal axis 104, have a cross-sectional area that is greater than or equal to 10% of the cross-sectional area, in the same plane 118, defined by the inner surface 108. In some embodiments, the cross-sectional area in a plane perpendicular to the longitudinal axis 104 of the longitudinally extending grooves can be between 10% and 50% of the cross-sectional area, in the same plane, defined by the inner surface. It is contemplated that the cross-section area of the longitudinally extending grooves can be determined as the difference between (a) the cross-sectional area of the interior space 130 defined by the inner surface with grooves present; and (b) the cross-sectional area of the interior space defined by the inner surface if the grooves were not present (e.g., if the inner surface had a common diameter moving circumferentially around the drill rod).

Figure 2A:
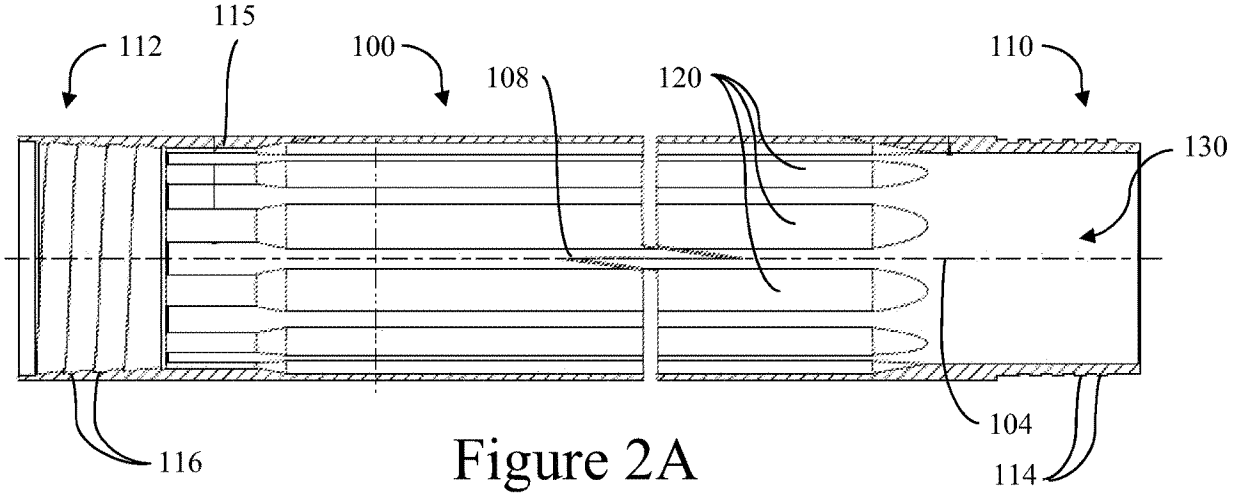
Figure 3A:
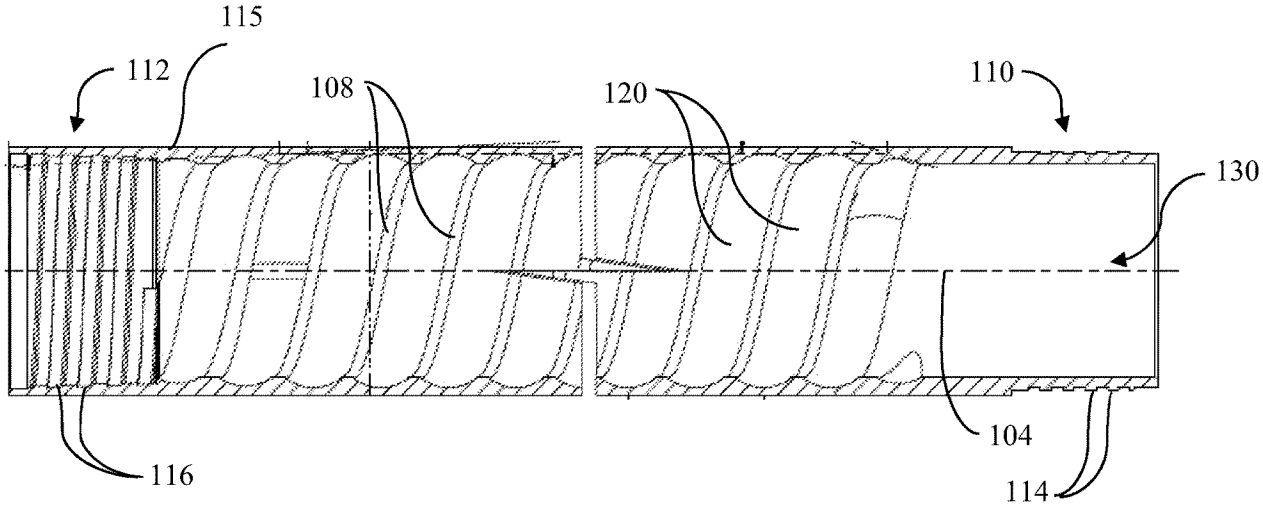

The total fluid bypass passage can have a cross-sectional area similar to what is normally provided in typical drilling accessories (e.g., loading chambers, water swivels, and hoist plugs). For example, such drilling accessories can have a ½" diameter bore minimally, a ⅝" diameter bore more commonly, a ¾" diameter bore on larger tooling, and a 1" or 1-¼" diameter bore on the largest water swivels. The larger the total fluid bypass cross-sectional area, the faster a retained column of fluid can be drained with lower fluid-drag on an inner assembly, such as an overshot, a head assembly, or an inner tube (core barrel) assembly. Similarly, a larger area results in a lower fluid drag, therefore requiring a lower pressure to supply fluid around a retained inner assembly. The longitudinal grooves 120 can have varying depth. That is, some longitudinal grooves can have depths that are greater than other longitudinal grooves. Moreover, the depth of a single longitudinal groove can vary along the length of the groove. The depth of the grooves at the drill rod's midbody (i.e., between the male and female threads on the opposing first and second ends of the drill rod) can be limited by the drill rod's wall thickness. That is, the groove depth cannot extend past the outer surface of the wall of the drill rod. As shown in FIGS. 2A and 3A, where the grooves overlap with the female joint portion (generally referred to as the second end 112) of the rod at a transition region 115 between the midbody and the female threads, the internal torque shoulder of the female joint portion can limit the groove depth to avoid cutting through the threads (and to ensure that the shoulder is maintained). That is, within transition region 115, where portions of the grooves overlap with the female joint portion of the rod (and, optionally, are positioned proximate or adjacent to the female threads), the major diameter of the grooves cannot be greater than the minor diameter of the threads 116. For this reason, a variable groove depth can allow for greater bypass around the seal on a retained inner assembly. In this way, a maximum groove depth can be positioned at certain locations (e.g., where the inner assembly is disposed), while the grooves can have shallower depths as required for avoiding threads and other elements at locations along the drill rod's axis where the effect of the shallower groove depth has less of a back pressure effect. For example, a maximum allowable groove depth can be desired through the drill rod's internal torque shoulder, thereby allowing fluid to bypass as an inner assembly is being removed from, or inserted into, the drill rod string. Such a configuration can minimize adverse fluid pressure loading on tooling during normally manual operations, resisting the driller.

Referring also to FIGS. 4-7, the inner surface 108 and the longitudinally extending grooves 120 can define an interior space 130. The interior space 130 can be sized and otherwise configured to receive an inner assembly 300. The inner assembly 300 can be, for example, an overshot. In some embodiments, the overshot can be a wireline overshot. In further embodiments, the overshot can be a strictly fluid-driven reversible overshot (i.e., a reverse circulation tripping overshot). Exemplary overshots include those disclosed in U.S. Pat. No. 9,540,897 to Longyear™, Inc. and in Applicant's U.S. patent application Ser. No. 15/240,142 (Application Publication No. 2017/0051571), each of which is incorporated herein by reference in its entirety. However, it is contemplated that the disclosed drill rod 100 can be compatible with any conventional overshot design. Although embodiments in which the inner assembly is an overshot are described herein, it should be understood that the inner assembly can be any structure that is advanced and retracted within a drill string as disclosed herein. For example, it is contemplated that the inner assembly 300 can be a head assembly or a core barrel (inner tube) assembly.

Conventionally, inner assemblies such as overshots and inner tube assemblies can include a holdback brake for use in an open rod string at any point during drilling operations. Such open rod string conditions typically bring a significant risk of inner tube expulsion by gravity or ground source fluid or gas flow. In use, the longitudinal grooves 120 of the rod disclosed herein can provide pressure relief that prevents such risk of inner tube expulsion, thereby avoiding a need for using a holdback brake with the inner assembly.

A drill string 200 (shown in part) having a drilling axis 202 can comprise one or more drill rods 100 having longitudinal grooves as disclosed herein. Optionally, the drill string 200 can further comprise one or more drill rods 220 having no longitudinal grooves and therefore having a continuous cylindrical inner surface 222. The drill rod 100 can be positioned at a proximal end 240 of the drill string, and the one or more drill rods 220 can be positioned distal of the drill rod 100.

Figure 4:
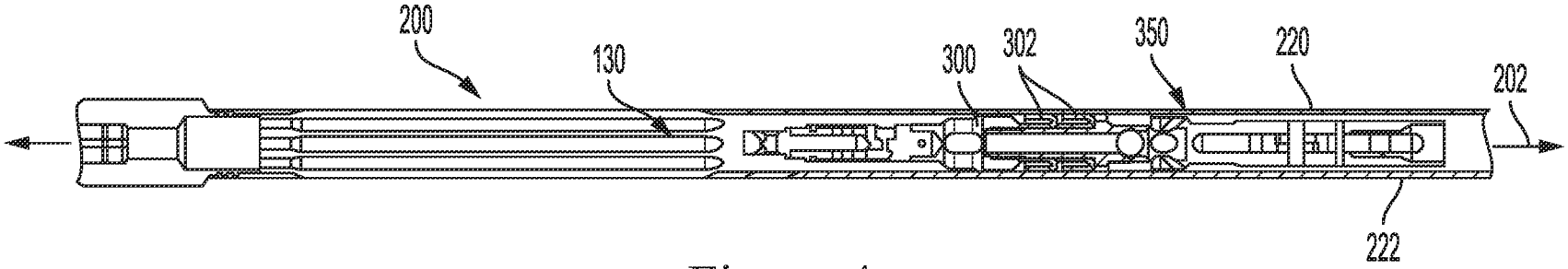
FIG. 4 is cutaway of a portion of a drill string including the drill rod as in FIG. 1 with an inner assembly disposed therein in a first position.
Figure 5:
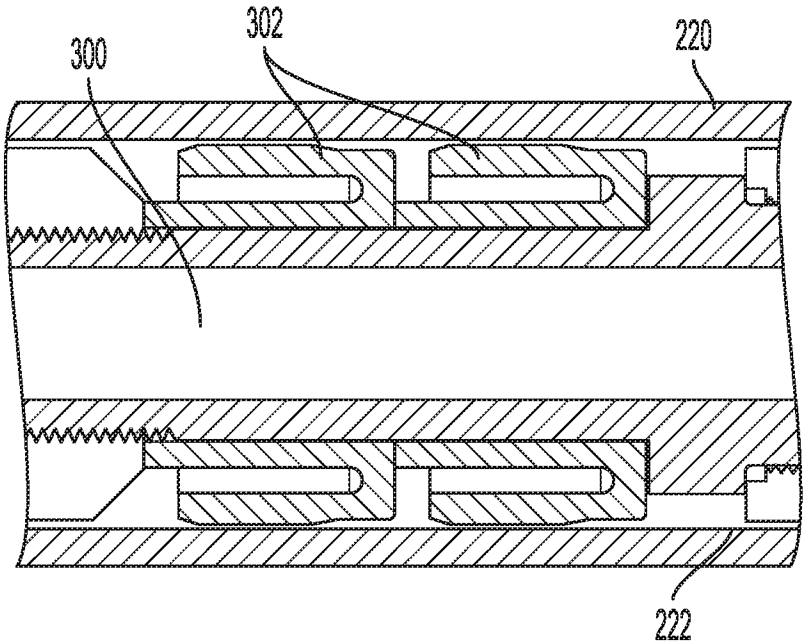
FIG. 5 is a close-up portion of the cutaway of FIG. 4.
Figure 6:
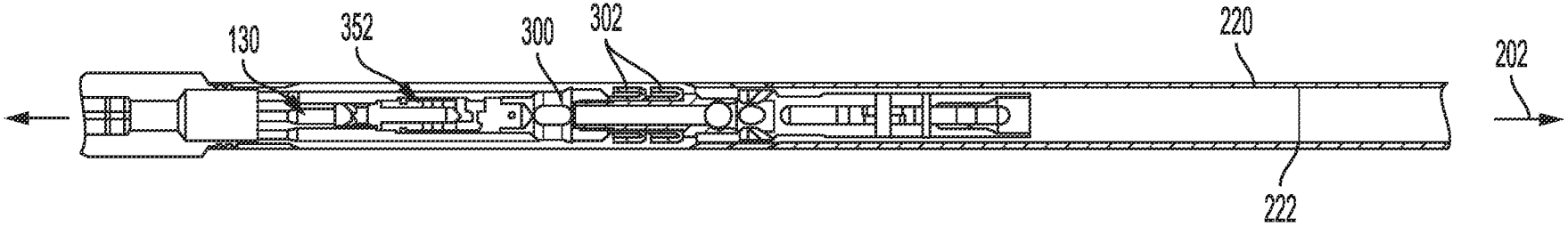
FIG. 6 is cutaway of the portion of the drill string as in FIG. 4 with the inner assembly disposed therein in a second position.
Figure 7:
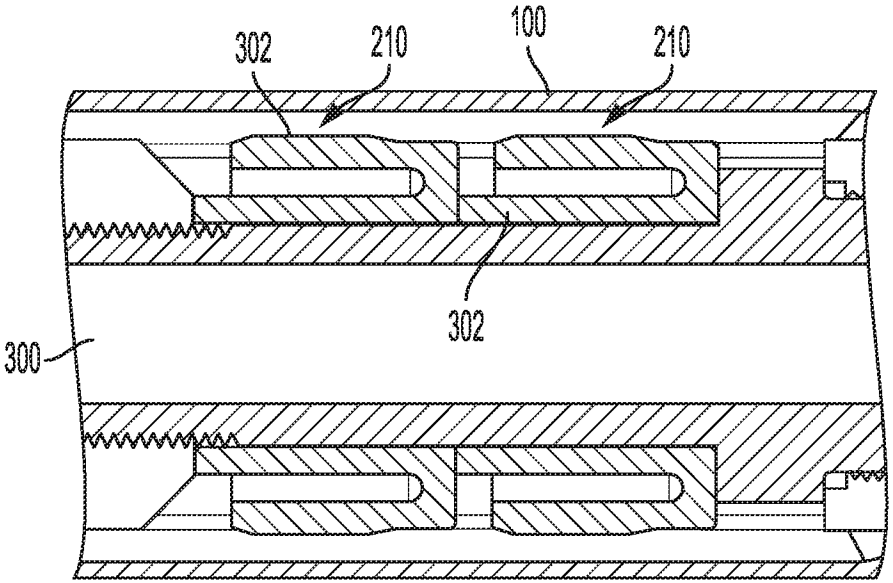
FIG. 7 is a close-up portion of the cutaway of FIG. 6.

The drill string 200 can comprise an inner assembly 300 positioned within at least one of the drill rods 100, 220. The inner assembly 300 can be movable from a first, advanced position 350, as shown in FIG. 4, to a second, retracted position 352, as shown in FIG. 6. The inner assembly 300 can have one or more sealing elements 302 (e.g., pump-in seals) that are configured to engage inner surfaces of the drill rods 100, 220, which can include the inner surface 108 of drill rod 100 and the inner surface 222 of drill rods 220. Exemplary pump-in seals include those disclosed in U.S. Pat. No. 8,770,319 to Longyear™, Inc., which is incorporated herein by reference in its entirety. As shown in FIG. 5, when the inner assembly 300 is in the first position 352, the sealing surfaces engage the drill rod 220 along its continuous (groove-less) interior circumference. Therefore, the sealing elements 302 seal around the drill rod's entire circumference and prevent fluid from traveling past the seals and through the drill string. In the retracted position 352, the sealing elements 302 can be disposed within the interior space 130 of drill rod 100 adjacent the grooves 120. The sealing elements 302 can engage and bias against the interior surface 108. The grooves 120 and the sealing elements 302 can cooperate to define gaps 210 through which fluid can travel, while the engagement between the sealing elements 302 and the interior surface 108 ensures that the sealing elements do not seal off the grooves. Accordingly, the longitudinally extending grooves 120 of the drill rod body 100 can permit axial flow of fluid through the drill rod as portions of the sealing elements engage the inner surface 108 of the drill rod body 100.

A system 400 can include a drill string 200. The system can be used according to the following method. The sealing elements 302 of the inner assembly can be in their closed positions within the interior space 130 of the drill rod 100. Accumulated fluid can be allowed to flow axially through the grooves 120 in a proximal direction. For example, during loading of an empty drill string, it can be advantageous to permit proximal flow of water (or other fluid) to avoid the need for inserting the drill string against significant pressure. As another example, during retrieval of an inner assembly in an up-hole drilling operation, it can be advantageous to permit proximal flow of water (or other fluid) to avoid the dangerous situation of a large column of water (or other fluid) exiting the drill hole. Additionally, or alternatively, fluid can be allowed to flow axially through the grooves 120 in a distal direction. For example, distal flow can pass through the grooves 120 and around proximal tooling (e.g., a retained overshot, or "running overshot") in order to affect distally located tooling, such as an inner tube assembly. For example, distal flow around the proximal tooling can drive an assembly or drive a tool valve or a latch mechanism. In use, the system 400 can be used to perform a variety of drilling operations, including, for example, core retrieval (core sampling) operations. It is contemplated that the system 400 can be used during either underground or surface drilling.

In some embodiments, the drill rod 100 can be formed using a cold forming process. A forming tool can be hydraulically driven through the tube to form the longitudinal grooves. Alternatively, a hydro-forming process can use fluid pressure to form the tube against an interior mold, thereby forming the longitudinal grooves. Cold forming processes as discussed can form, under some circumstances, exterior ribs that are complementary to the interior grooves. In some situations, these grooves, depending on the application, may or may not be preferable. In situations for which a smooth or cylindrical exterior surface is desirable, tooling can be developed to limit or prevent such ribs from forming.

In some embodiments, rather than machining the longitudinally extending grooves through the interior bore of the drill rod 100, it is contemplated that the drill rod 100 can comprise a slotted, cylindrical inner member having one or more longitudinal through-slots that extend radially from an inner surface to an outer surface. In these embodiments, the drill rod 100 can further comprise a sleeve that circumferentially surrounds the inner member and does not comprise slots. The slotted inner member can be positioned within the sleeve, thereby providing a drill rod having one or more longitudinally extending channels defined by the radially extending edges of the slots and the inner surface of the sleeve. The sleeve may be welded, bonded, or otherwise attached and sealed to the inner member so that fluid cannot travel between the inner cylindrical member and the outer sleeve. Accordingly, this may provide an alternative manufacturing method for producing a drill rod having longitudinal slots without the difficulty of machining through the internal bore of the drill rod.

Figure 8:
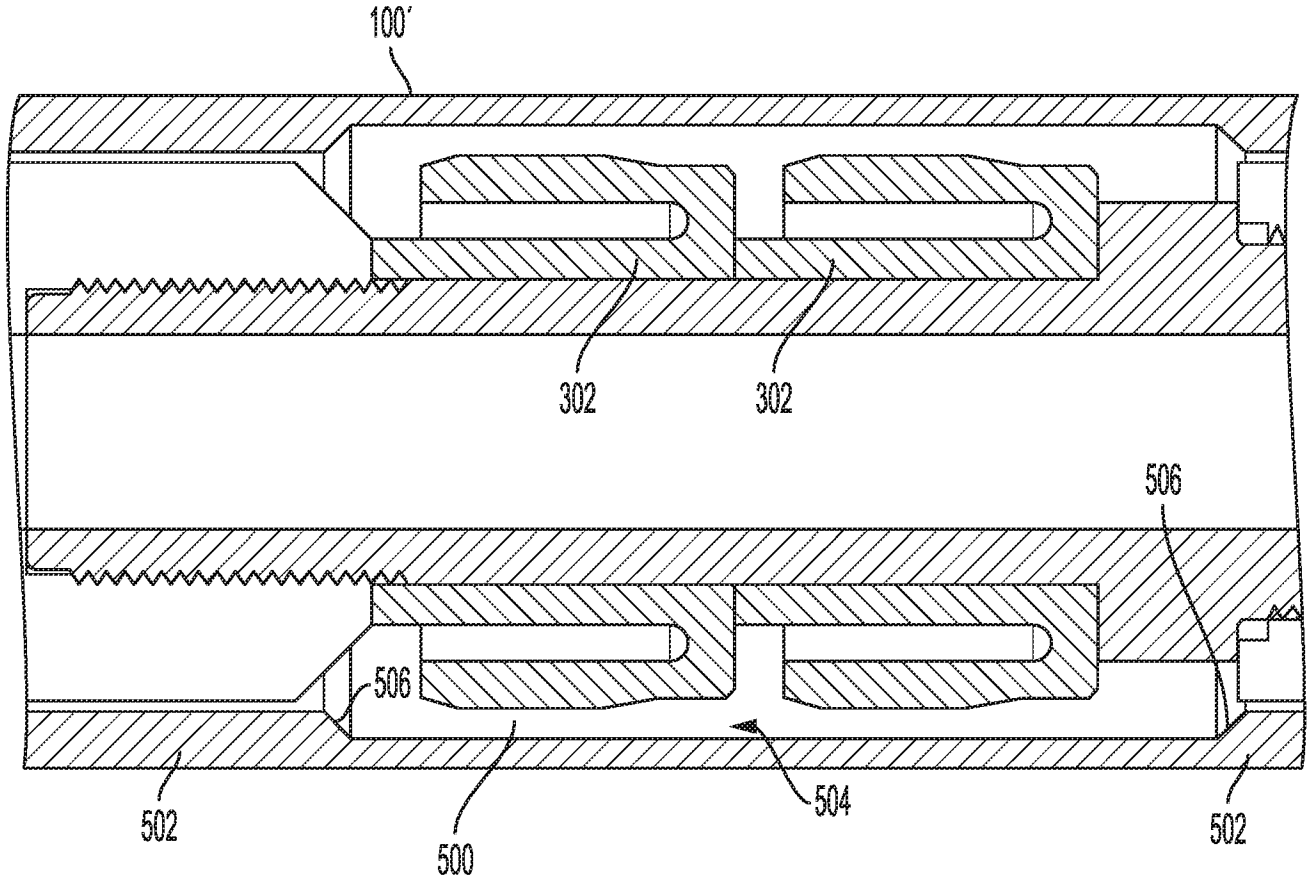
FIG. 8 is a cutaway side view of a portion of a drill rod having an axial groove and sealing elements disposed within the axial groove as disclosed herein.

Referring to FIG. 8, a drill rod 100' can have an axial groove 500 extending around some or all of the inner circumference of the drill rod. The axial groove 500 can have a greater inner diameter than on opposing longitudinal ends 502 of the axial groove 500. In this way, when the sealing elements 302 are disposed within the axial groove, the axial groove 500 and sealing elements 302 can cooperate to define a gap 504 through which fluid can travel around, and thereby bypass, the sealing elements 302. The axial groove 500 can comprise respective tapers 506 at its longitudinal ends in order to facilitate tool travel therethrough. It is contemplated that the drill rod 100 can have a larger outer diameter at the axial groove in order to maintain a necessary wall thickness. Optionally, the outer diameter of the drill rod can be increased at the axial grooves in order to maintain a consistent or substantially consistent wall thickness.

Exemplary Aspects

In view of the described device, systems, and methods and variations thereof, herein below are certain more particularly described aspects of the invention. These particularly recited aspects should not, however, be interpreted to have any limiting effect on any different claims containing different or more general teachings described herein, or that the "particular" aspects are somehow limited in some way other than the inherent meanings of the language literally used therein.

Aspect 1: A drill rod configured to form a portion of a drill string defining a drilling axis, wherein the drill string is configured to receive an inner assembly as the inner assembly is advanced and retracted relative to the drilling axis, the drill rod comprising: a body having an outer surface, an inner surface, a longitudinal axis aligned with the drilling axis, and at least one longitudinally extending groove extending radially outwardly from the longitudinal axis relative to the inner surface, wherein the inner surface and the at least one longitudinally extending groove cooperate to define an interior space through which the inner assembly is received as the inner assembly is advanced and retracted relative to the drilling axis, wherein the at least one longitudinally extending groove of the body of the drill rod is configured to permit axial flow of fluid through the drill rod as portions of the inner assembly engage the inner surface of the body of the drill rod.

Aspect 2: The drill rod of aspect 1, wherein the at least one longitudinally extending groove of the body of the drill rod comprises a plurality of longitudinally extending grooves.

Aspect 3: The drill rod of aspect 2, wherein each longitudinally extending groove is oriented parallel or substantially parallel to the longitudinal axis of the body of the drill rod.

Aspect 4: The drill rod of aspect 2, wherein the plurality of longitudinally extending grooves have respective helical profiles.

Aspect 5: The drill rod of any one of the preceding aspects, wherein the body of the drill rod comprises respective male and female end portions that define respective portions of the outer and inner surfaces of the body, and wherein the male end portion defines an outer thread extending radially outwardly from the outer surface of the body.

Aspect 6: The drill rod of aspect 5, wherein the female end portion of the body of the drill rod defines an inner thread on the inner surface of the body.

Aspect 7: The drill rod of aspect 5 or aspect 6, wherein the at least one longitudinally extending groove is longitudinally spaced from the male end portion of the body of the drill rod.

Aspect 8: The drill rod of aspect 3 or aspect 4, wherein the plurality of longitudinally extending grooves are equally or substantially equally circumferentially spaced about the inner surface of the body of the drill rod.

Aspect 9: The drill rod of aspect 3, wherein the plurality of longitudinally extending grooves comprises from 6 to 14 grooves.

Aspect 10: The drill rod of aspect 3, wherein the plurality of longitudinally extending grooves comprises 10 grooves.

Aspect 11: The drill rod of aspect 4, wherein the plurality of longitudinally extending grooves comprises two grooves that are circumferentially spaced 180 degrees apart from one another.

Aspect 12: The drill rod of aspect 4, wherein the plurality of longitudinally extending grooves comprises at least three grooves.

Aspect 13: The drill rod of aspect 3, wherein the longitudinally extending grooves have variable depths.

Aspect 14: The drill rod of aspect 1, wherein a cross-sectional area defined by the at least one groove, defined by a plane that is perpendicular to the longitudinal axis, is at least ten percent of a cross-sectional area defined by the inner surface of the body of the drill rod in the plane.

Aspect 15: The drill rod of aspect 14, wherein the cross-sectional area defined by the at least one groove is between ten percent and fifty percent of the cross-sectional area defined by the inner surface of the body of the drill rod.

Aspect 16: The drill rod of aspect 3 or aspect 4, wherein the plurality of longitudinally extending grooves are circumferentially spaced apart by unequal amounts about the inner surface of the body of the drill rod.

Aspect 17: A drilling system comprising a drill string including the drill rod of any one of aspects 1-16; and an inner assembly including at least one sealing element that is configured to engage inner surfaces of the drill string, wherein the at least one longitudinally extending groove of the body of the drill rod is configured to permit axial flow of fluid through the drill rod as portions of the at least one sealing element of the inner assembly engage the inner surface of the body of the drill rod.

Aspect 18: The drilling system of aspect 17, wherein the at least one sealing element is a pump-in seal.

Aspect 19: The drilling system of aspect 17 or aspect 18, wherein the drill rod is a first drill rod of a plurality of drill rods of the drill string, wherein the first drill rod is positioned at a proximal end of the drill string, wherein the drill string comprises a plurality of distally positioned drill rods having a cylindrical inner surface and positioned distal of the first drill rod, and wherein the at least one sealing element is configured to form a fluid seal with the inner surface of at least one of the distally positioned drill rods.

Aspect 20: The drilling system of aspect 19, wherein the inner assembly comprises an overshot.

Aspect 21: The drilling system of aspect 20, wherein the overshot is one of a wireline overshot and a strictly fluid-driven reversible overshot.

Aspect 22: A method of using the drilling system of any one of aspects 17-21, comprising: positioning the at least one sealing element of the inner assembly within the interior space of the drill rod having the at least one longitudinally extending groove.

Aspect 23: The method of aspect 22, further comprising, with the at least one sealing element within the interior space of the drill rod having the at least one longitudinally extending groove, allowing accumulated fluid to flow axially through the at least one longitudinally extending groove in a proximal direction.

Aspect 24: The method of aspect 22, further comprising, with the at least one sealing element within the interior space of the drill rod having the at least one longitudinally extending groove, directing fluid axially through the at least one longitudinally extending groove in a distal direction.

Aspect 25: A drill rod configured to form a portion of a drill string defining a drilling axis, wherein the drill string is configured to receive an inner assembly as the inner assembly is advanced and retracted relative to the drilling axis, the drill rod comprising: a body having an outer surface, an inner surface, a longitudinal axis aligned with the drilling axis, and a bore therethrough, wherein the bore defines at least one axial groove having an inner diameter that is greater than a diameter of the bore on each longitudinal side of the groove, wherein the at least one axial groove of the body of the drill rod is configured to permit axial flow of fluid around at least one seal of the inner assembly within the drill rod.

Those skilled in the art will recognize, or be able to ascertain using no more than routine experimentation, many equivalents to the specific embodiments of the method and compositions described herein. Such equivalents are intended to be encompassed by the following claims.

What is claimed is:

1. A drill rod configured to form a portion of a drill string defining a drilling axis, wherein the drill string is configured to receive an inner assembly as the inner assembly is advanced and retracted relative to the drilling axis, the drill rod comprising:

a body having an outer surface, an inner surface, a longitudinal axis aligned with the drilling axis, opposing male and female end portions, and at least one longitudinally extending groove extending radially outwardly from the inner surface, wherein the inner surface and the at least one longitudinally extending groove cooperate to define an interior space through which the inner assembly is received as the inner assembly is advanced and retracted relative to the drilling axis, wherein the inner surface has a consistent diameter between the male and female end portions of the drill rod, wherein the at least one longitudinally extending groove of the body of the drill rod is configured to permit axial flow of fluid through the drill rod as portions of the inner assembly engage the inner surface of the body of the drill rod, wherein the male end portion of the body defines an outer thread extending radially outwardly from the outer surface of the body, wherein the at least one longitudinally extending groove is longitudinally spaced from the male end portion of the body of the drill rod, and wherein the at least one longitudinally extending groove of the body of the drill rod comprises a plurality of longitudinally extending grooves, wherein each longitudinally extending groove is oriented parallel or substantially parallel to the longitudinal axis of the body of the drill rod, and wherein the longitudinally extending grooves have variable depths.

2. The drill rod of claim 1, wherein the plurality of longitudinally extending grooves are equally or substantially equally circumferentially spaced about the inner surface of the body of the drill rod.

3. The drill rod of claim 1, wherein the plurality of longitudinally extending grooves comprises from 6 to 14 grooves.

4. The drill rod of claim 1, wherein the plurality of longitudinally extending grooves comprises 10 grooves.

5. The drill rod of claim 1, wherein a cross-sectional area defined by the at least one groove, defined by a plane that is perpendicular to the longitudinal axis, is at least ten percent of a cross-sectional area defined by the inner surface of the body of the drill rod in the plane.

6. The drill rod of claim 5, wherein the cross-sectional area defined by the at least one groove is between ten percent and fifty percent of the cross-sectional area defined by the inner surface of the body of the drill rod.

7. The drill rod of claim 1, wherein the plurality of longitudinally extending grooves are circumferentially spaced apart by unequal amounts about the inner surface of the body of the drill rod.

8. The drill rod of claim 1, wherein each groove of the at least one groove has a respective first depth between the male and female end portions, wherein the drill rod comprises a transition region at the female end portion in which each groove of the at least one groove has a respective second depth that is less than the respective first depth.

9. A drilling system comprising:

a drill string defining a drilling axis, wherein the drill string comprises a drill rod, wherein the drill rod comprises:

a body having an outer surface, an inner surface, a longitudinal axis aligned with the drilling axis, opposing male and female end portions, and at least one longitudinally extending groove extending radially outwardly from the inner surface, wherein the inner surface and the at least one longitudinally extending groove cooperate to define an interior space; and an inner assembly including at least one sealing element that is configured to engage the inner surface of the drill string, wherein the inner surface has a consistent diameter between the male and female end portions of the drill rod, wherein the inner assembly is received through the interior space as the inner assembly is advanced and retracted relative to the drilling axis, wherein the at least one longitudinally extending groove of the body of the drill rod is configured to permit axial flow of fluid through the drill rod as portions of the inner assembly engage the inner surface of the body of the drill rod, wherein the male end portion of the body defines an outer thread extending radially outwardly from the outer surface of the body, wherein the at least one longitudinally extending groove is longitudinally spaced from the male end portion of the body of the drill rod, and wherein the at least one longitudinally extending groove of the body of the drill rod is configured to permit axial flow of fluid through the drill rod as portions of the at least one sealing element of the inner assembly engage the inner surface of the body of the drill rod.

10. The drilling system of claim 9, wherein the at least one sealing element is a pump-in seal.

11. The drilling system of claim 9, wherein the drill rod is a first drill rod of a plurality of drill rods of the drill string, wherein the first drill rod is positioned at a proximal end of the drill string, wherein the drill string comprises a plurality of distally positioned drill rods having a cylindrical inner surface and positioned distal of the first drill rod, and wherein the at least one sealing element is configured to form a fluid seal with the inner surface of at least one of the distally positioned drill rods.

12. The drilling system of claim 11, wherein the inner assembly comprises an overshot.

13. The drilling system of claim 12, wherein the overshot is one of a wireline overshot and a strictly fluid-driven reversible overshot.

14. A method comprising:

using a drilling system, the drilling system comprising:

a drill string defining a drilling axis, wherein the drill string comprises a drill rod, wherein the drill rod comprises:

a body having an outer surface, an inner surface, a longitudinal axis aligned with the drilling axis, opposing male and female end portions, and at least one longitudinally extending groove extending radially outwardly from the inner surface, wherein the inner surface and the at least one longitudinally extending groove cooperate to define an interior space through which the inner assembly is received as the inner assembly is advanced and retracted relative to the drilling axis, wherein the inner surface has a consistent diameter between the male and female end portions of the drill rod, wherein the male end portion of the body defines an outer thread extending radially outwardly from the outer surface of the body, wherein the at least one longitudinally extending groove is longitudinally spaced from the male end portion of the body of the drill rod, and wherein the at least one longitudinally extending groove of the body of the drill rod is configured to permit axial flow of fluid through the drill rod as portions of the inner assembly engage the inner surface of the body of the drill rod; and an inner assembly including at least one sealing element that is configured to engage inner surfaces of the drill string, wherein the at least one longitudinally extending groove of the body of the drill rod is configured to permit axial flow of fluid through the drill rod as portions of the at least one sealing element of the inner assembly engage the inner surface of the body of the drill rod;

positioning the at least one sealing element of the inner assembly within the interior space of the drill rod having the at least one longitudinally extending groove; and with the at least one sealing element within the interior space of the drill rod having the at least one longitudinally extending groove, causing fluid to flow axially through the at least one longitudinally extending groove.

15. The method of claim 14, wherein the fluid is accumulated fluid that flows axially through the at least one longitudinally extending groove in a proximal direction.

16. The method of claim 14, wherein the fluid is directed axially through the at least one longitudinally extending groove in a distal direction.

17. The drilling system of claim 9, further comprising the inner assembly positioned within the interior space of the drill rod having the at least one longitudinally extending groove, wherein the at least one sealing element of the inner assembly is positioned so that the at least one longitudinally extending groove provides flow communication around the at least one sealing element.

18. A drill rod configured to form a portion of a drill string defining a drilling axis, wherein the drill string is configured to receive an inner assembly as the inner assembly is advanced and retracted relative to the drilling axis, the drill rod comprising:

a body having an outer surface, an inner surface, a longitudinal axis aligned with the drilling axis, opposing male and female end portions, and at least one longitudinally extending groove extending radially outwardly from the inner surface, wherein the inner surface and the at least one longitudinally extending groove cooperate to define an interior space through which the inner assembly is received as the inner assembly is advanced and retracted relative to the drilling axis, wherein the inner surface has a consistent diameter between the male and female end portions of the drill rod, wherein the at least one longitudinally extending groove of the body of the drill rod is configured to permit axial flow of fluid through the drill rod as portions of the inner assembly engage the inner surface of the body of the drill rod, wherein the male end portion of the body defines an outer thread extending radially outwardly from the outer surface of the body, wherein the at least one longitudinally extending groove is longitudinally spaced from the male end portion of the body of the drill rod, wherein the at least one longitudinally extending groove of the body of the drill rod comprises a plurality of longitudinally extending grooves, wherein each longitudinally extending groove is oriented parallel or substantially parallel to the longitudinal axis of the body of the drill rod, and wherein the plurality of longitudinally extending grooves comprises from 6 to 14 grooves.

19. The drill rod of claim 18, wherein the plurality of longitudinally extending grooves are equally or substantially equally circumferentially spaced about the inner surface of the body of the drill rod.

20. The drill rod of claim 18, wherein a cross-sectional area defined by the at least one groove, defined by a plane that is perpendicular to the longitudinal axis, is at least ten percent of a cross-sectional area defined by the inner surface of the body of the drill rod in the plane.

* * * * *